US005966817A

United States Patent [19]

Lee

[11] Patent Number: 5,966,817

[45] Date of Patent: Oct. 19, 1999

[54] ART DESIGNER BLADE DEVICE

[76] Inventor: Tze-Ming Lee, 58, Ma Yuan West St., Taichung, Taiwan

[21] Appl. No.: 09/226,283

[22] Filed: Jan. 7, 1999

[30] Foreign Application Priority Data

Feb. 23, 1998 [TW] Taiwan ..... 87202572

[51] Int. Cl.[6] ..... B26B 1/08

[52] U.S. Cl. ..... 30/162; 30/335

[58] Field of Search ..... 30/162, 335, 2, 30/151, 30

[56] References Cited

U.S. PATENT DOCUMENTS 2,243,030 5/1941 Fischer ..... 30/162 X
4,240,202 12/1980 Gilbert ..... 30/162 X
5,025,558 6/1991 Gilbert ..... 30/162 X
5,207,696 5/1993 Matwijcow ..... 30/335 X
5,426,855 6/1995 Keklak et al. ..... 30/162
5,875,551 3/1999 Huang ..... 30/151

*Primary Examiner*—Douglas D. Watts

[57] ABSTRACT

An art designer blade device has a first hollow casing, a second hollow casing coupling with the first hollow casing, and an end cover covering the first hollow casing and the second hollow casing, a lower seat disposed between the first hollow casing and the second hollow casing, a blade holder disposed in the art designer blade device, and the blade holder holding a blade.

4 Claims, 6 Drawing Sheets

ART DESIGNER BLADE DEVICE

BACKGROUND OF THE INVENTION

The present invention relates to an art designer blade device. More particularly, the present invention relates to an art designer blade device which facilitates the replacement of a blade.

A conventional art designer blade device has a blade, a push button, an elastic plate, and a blade holder. The elastic plate is disposed in the blade holder. The blade holder has a plurality of serrations engaging with the elastic plate. Therefore, the user can push the push button forward. However, it is difficult to replace the blade. The blade will be extended step by step to make noise.

SUMMARY OF THE INVENTION

An object of the present invention is to provide a an art designer blade device in order to replace a blade easily.

Accordingly, an art designer blade device comprises a first hollow casing, a second hollow casing coupling with the first hollow casing, and an end cover covering the first hollow casing and the second hollow casing, a hollow lower seat disposed between the first hollow casing and the second hollow casing, a blade holder disposed in the art designer blade device, and the blade holder holding a blade. The first hollow casing has a plurality of threaded posts, a taper recess formed on an upper portion of the first hollow casing, a through hole communicating with the taper recess, a round hole communicating with the through hole, an upper chamber formed in the first hollow casing, a lower chamber formed in the first hollow casing, an end chamber formed in an end portion of the first hollow casing, a guide groove formed in a front portion of the first hollow casing, a first distal groove formed in the front portion of the first hollow casing, a compression spring inserted in the upper chamber, and a coiled spring inserted in the lower chamber. The second hollow casing has a circular hole formed on a center portion of the second hollow casing, a taper notch formed in the second hollow casing, a second distal groove formed in a front portion of the second hollow casing, and a plurality of pillars matching the threaded posts. Each of the pillars is inserted in the respective threaded post. The blade holder has a front seat, a plurality of positioning rods disposed in the front seat, an insertion block, an upper plate disposed on the insertion block, and a plurality of cylinder posts disposed on the upper plate. The blade holder is inserted in the guide groove. The blade has a plurality of apertures. Each of the positioning rods is inserted in the respective aperture. The insertion block engages with the hollow lower seat. A button device has a push plate disposed on a top portion of the button device, a lower rod disposed on a bottom of the button device, a lower protrusion disposed on the bottom of the button device, and a positioning post disposed on a distal portion of the button device. The push plate is inserted in the taper recess. The lower protrusion is inserted in the through hole. A rotating wheel has a center hole receiving the lower rod, a lower taper cone portion, and a helix bar disposed on the lower taper cone portion to engage with the cylinder posts. The rotating wheel is inserted in the round hole and the circular hole. The hollow lower seat has a threaded hole and a distal plate. A distal post is disposed on the distal plate. The distal plate engages with the insertion block. The end cover has a pivot hole. The positioning post is inserted in the upper chamber. The compression spring is disposed between the positioning post and the button device. The compression spring pushes the button device.

The art designer blade device further comprises a socket seat which comprises a hollow interior receiving the art designer blade device, two positioning bars disposed in the socket seat to position the art designer blade device, a hollow handle device disposed on a lateral of the socket seat, a rectangular frame disposed on the socket seat, a periphery groove formed on the hollow handle device, a plurality of rectangular holes formed on the hollow handle device, an elastic plate inserted in the rectangular frame, and a lateral cover covering the hollow handle device. The lateral cover comprises a plurality of clamp hooks and a semicular groove. Each of the clamp hooks is inserted in the respective rectangular hole. A rectangular plate is disposed between the elastic plate and the lateral cover.

DETAILED DESCRIPTION OF THE INVENTION

Figure 1:
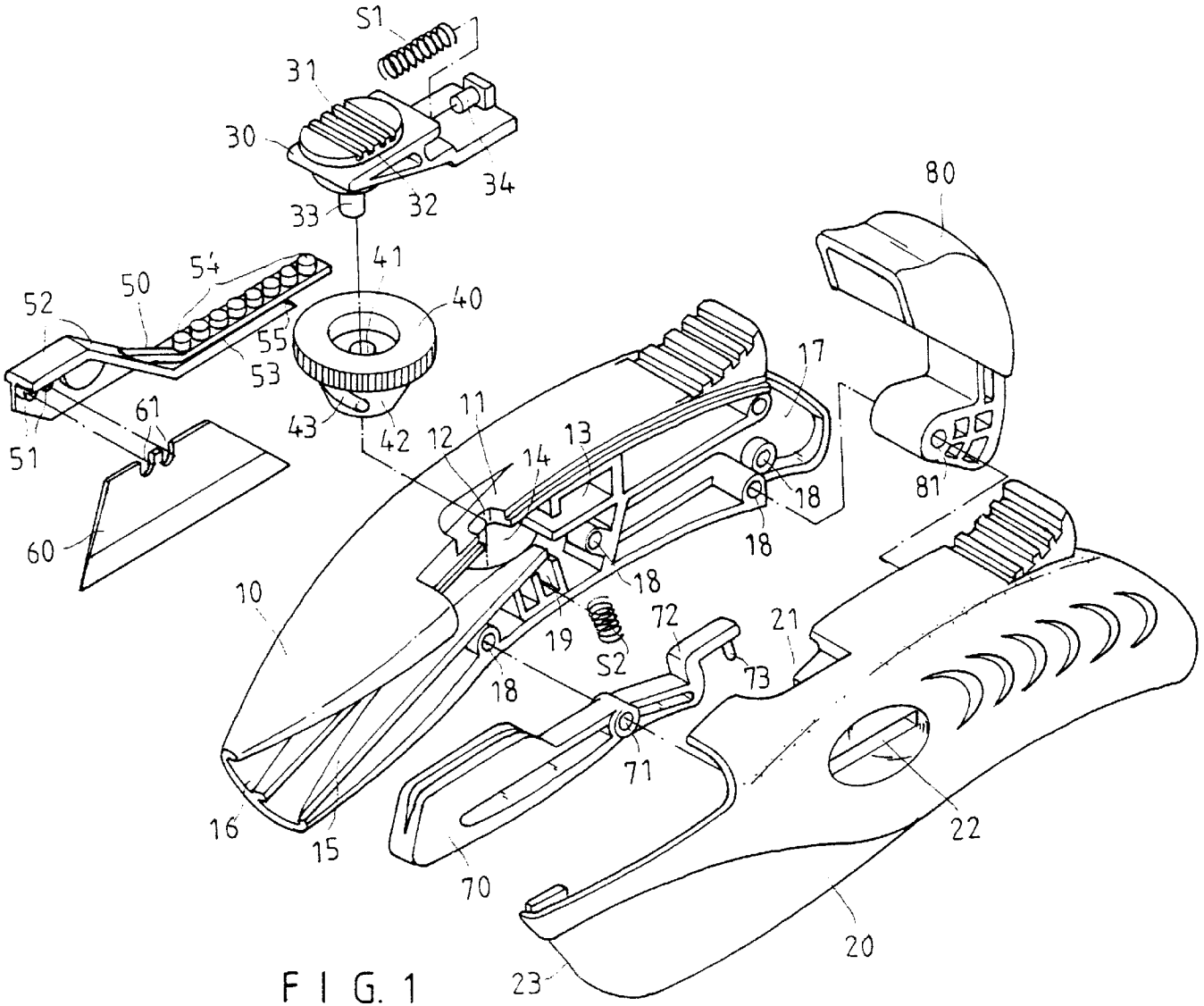
FIG. 1 is a perspective exploded view of an art designer blade device of a preferred embodiment in accordance with the present invention.
Figure 2:
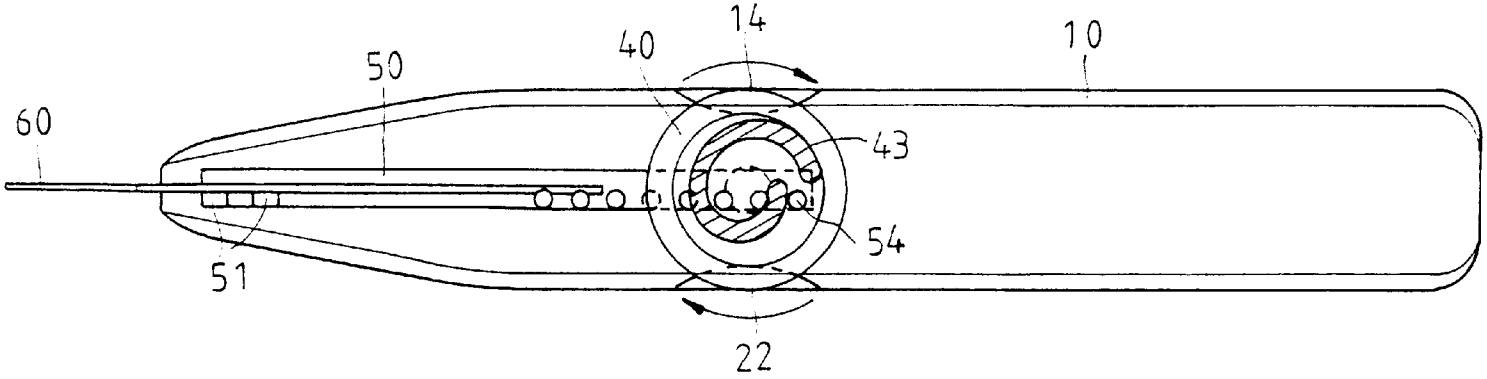
FIG. 2 is a schematic view illustrating an extension of a blade.
Figure 3:
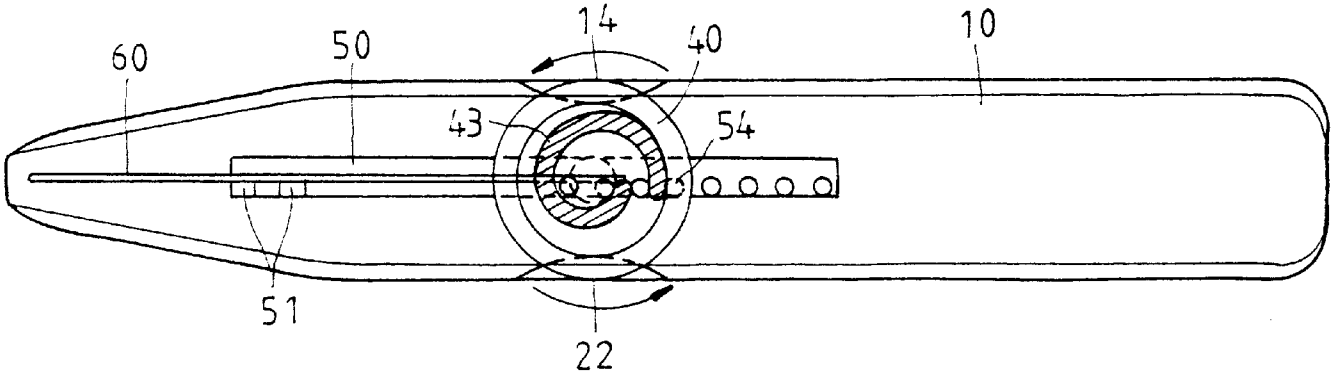
FIG. 3 is a schematic view illustrating a retraction of a blade.
Figure 4:
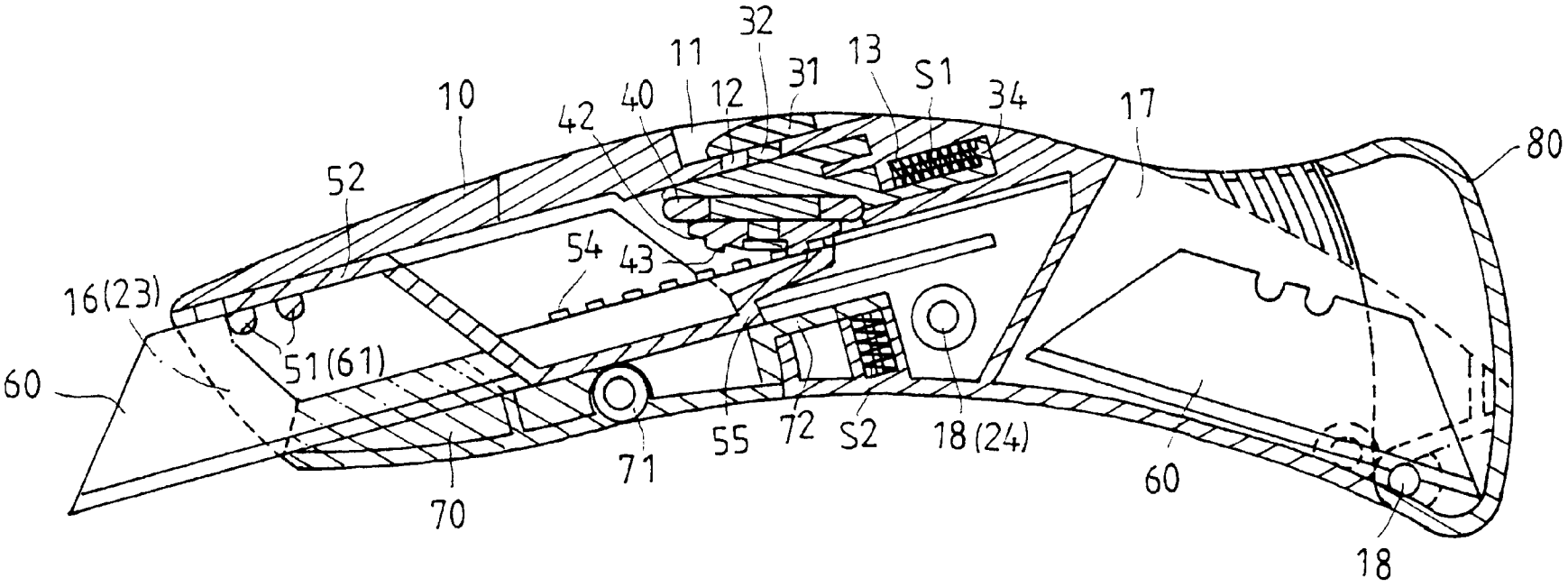
FIG. 4 is a sectional assembly view of an art designer blade device of a preferred embodiment in accordance with the present invention.

Referring to FIGS. 1 to 4, an art designer blade device comprises a first hollow casing 10, a second hollow casing 20 coupling with the first hollow casing 10, and an end cover 80 covering the first hollow casing 10 and the second hollow casing 20, a hollow lower seat 70 disposed between the first hollow casing 10 and the second hollow casing 20, a blade holder 50 disposed in the art designer blade device, and the blade holder 50 holding a blade 60.

The first hollow casing 10 has a plurality of threaded posts 18, a taper recess 11 formed on an upper portion of the first hollow casing 10, a through hole 12 communicating with the taper recess 11, a round hole 14 communicating with the through hole 12, an upper chamber 13 formed in the first hollow casing 10, a lower chamber 19 formed in the first hollow casing 10, an end chamber 17 formed in an end portion of the first hollow casing 10, a guide groove 15 formed in a front portion of the first hollow casing 10, a first distal groove 16 formed in the front portion of the first hollow casing 10, a compression spring S1 inserted in the upper chamber 13, and a coiled spring S2 inserted in the lower chamber 19.

The second hollow casing 20 has a circular hole 22 formed on a center portion of the second hollow casing 20, a taper notch 21 formed in the second hollow casing 20, a second distal groove 23 formed in a front portion of the second hollow casing 20, and a plurality of pillars 24 matching the threaded posts 18. Each of the pillars 24 is inserted in the respective threaded post 18.

The blade holder 50 has a front seat 52, a plurality of positioning rods 51 disposed in the front seat 52, an insertion block 55, an upper plate 53 disposed on the insertion block 55, and a plurality of cylinder posts 54 disposed on the upper plate 53. The blade holder 50 is inserted in the guide groove 15. The blade 60 has a plurality of apertures 61. Each of the positioning rods 51 is inserted in the respective aperture 61. The insertion block 55 engages with the hollow lower seat 70.

A button device 30 has a push plate 31 disposed on a top portion of the button device 30, a lower rod 33 disposed on a bottom of the button device 30, a lower protrusion 32 disposed on the bottom of the button device 30, and a positioning post 34 disposed on a distal portion of the button device 30. The push plate 31 is inserted in the taper recess 11. The lower protrusion 32 is inserted in the through hole 12.

A rotating wheel 40 has a center hole 41 receiving the lower rod 33, a lower taper cone portion 42, and a helix bar 43 disposed on the lower taper cone portion 42 to engage with the cylinder posts 54. The rotating wheel 40 is inserted in the round hole 14 and the circular hole 22.

The hollow lower seat 70 has a threaded hole 71 and a distal plate 72. A distal post 73 is disposed on the distal plate 72. The distal plate 72 engages with the insertion block 55.

The end cover 80 has a pivot hole 81.

The positioning post 34 is inserted in the upper chamber 13.

The compression spring S1 is disposed between the positioning post 34 and the button device 30. The compression spring S1 pushes the button device 30.

The coiled spring S2 can push the hollow lower seat 70.

The push plate 31 is pushed forward in order to move the rotating wheel 40 forward.

When the rotating wheel 40 is rotated clockwisely, the helix bar 43 will drive the blade holder 50 to move forward. The operation does not make noise.

When the rotating wheel 40 is rotated counterclockwisely, the helix bar 43 will drive the blade holder 50 to move rearward. The operation does not make noise.

Additional blades 60 can be placed in the end chamber 17.

Figure 5:
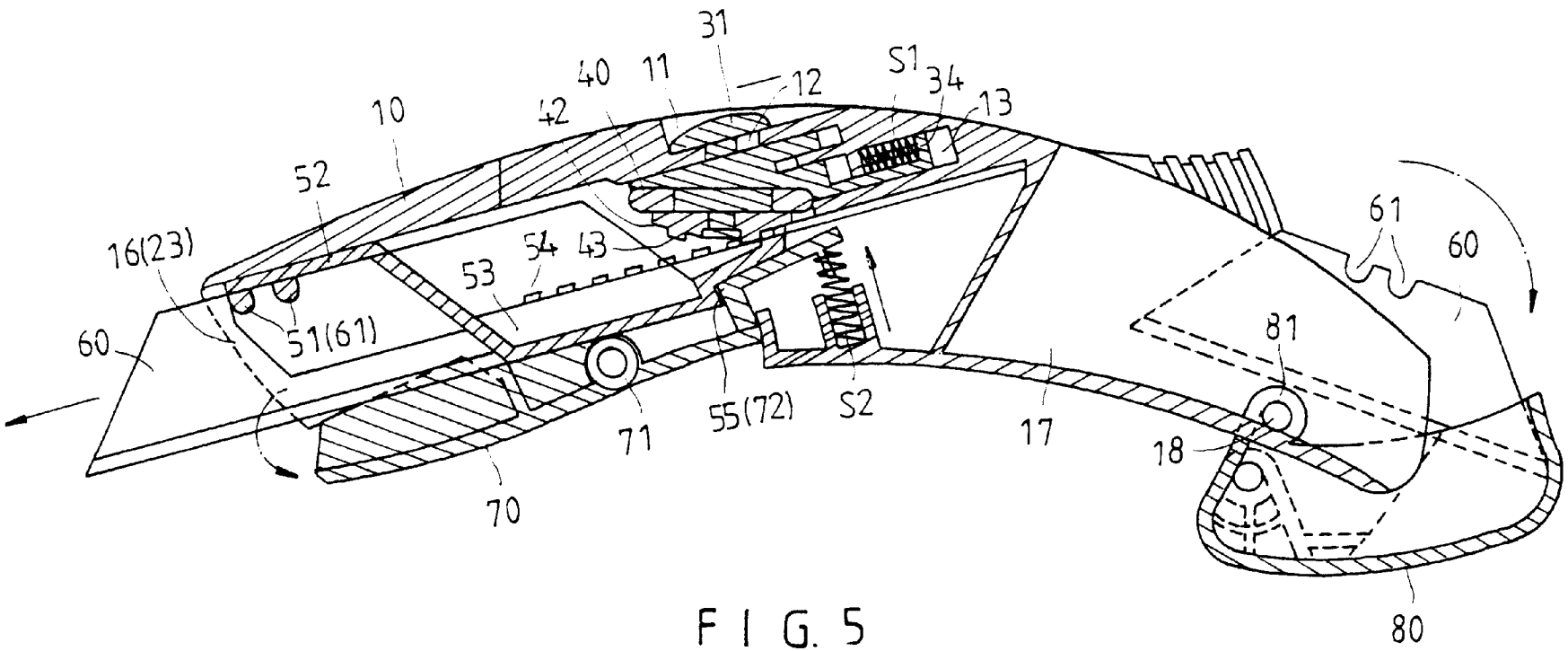
FIG. 5 is a schematic view illustrating a replacement of a blade.

Referring to FIG. 5, the blade 60 is extended out of the art designer blade device completely. The push plate 31 is pushed forward completely in order to move the rotating wheel 40 forward completely. Therefore, the insertion block 55 disengages from the distal plate 72 of the hollow lower seat 70. Then the coiled spring S2 pushes the hollow lower seat 70 to open. The user can replace the blade 60 from the blade holder 50 easily.

Figure 6:
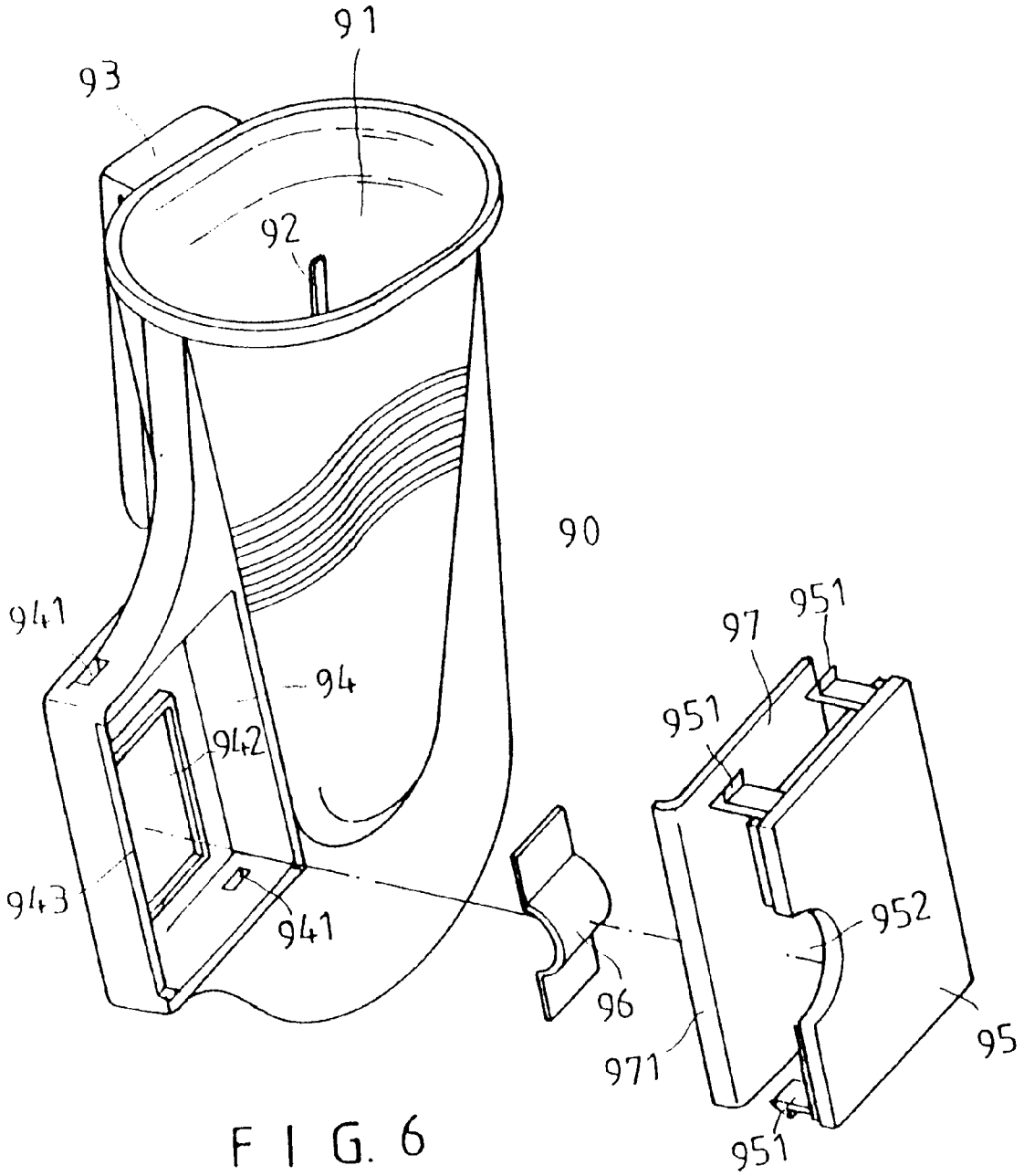
FIG. 6 is a perspective exploded view of a socket seat of a preferred embodiment in accordance with the present invention.
Figure 7:
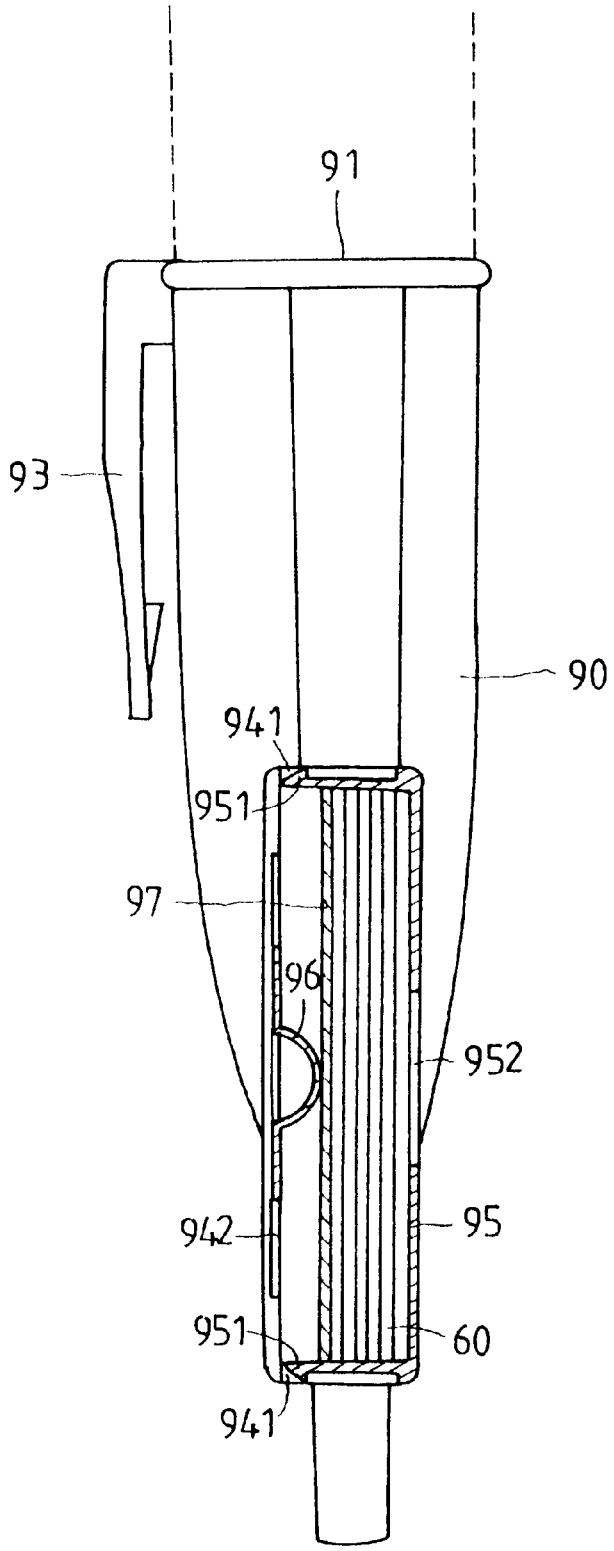
FIG. 7 is a sectional assembly view of a socket seat of a preferred embodiment in accordance with the present invention.

Referring to FIGS. 6 and 7, a socket seat 90 has a hollow interior 91 receiving the art designer blade device, two positioning bars 92 disposed in the socket seat 90 to position the art designer blade device, a hollow handle device 94 disposed on a lateral of the socket seat 90, a rectangular frame 942 disposed on the socket seat 90, a periphery groove 943 formed on the hollow handle device 94, a plurality of rectangular holes 941 formed on the hollow handle device 94, an elastic plate 96 inserted in the rectangular frame 942, and a lateral cover 95 covering the hollow handle device 94. The lateral cover 95 comprises a plurality of clamp hooks 951 and a semicular groove 952. Each of the clamp hooks 951 is inserted in the respective rectangular hole 941. A rectangular plate 97 is disposed between the elastic plate 96 and the lateral cover 95. A plurality of blades 60 are placed between the rectangular plate 97 and the lateral cover 95.

The invention is not limited to the above embodiment but various modification thereof may be made. Further, various changes in form and detail may be made without departing from the scope of the invention.

I claim:

1. An art designer blade device comprises:

a first hollow casing, a second hollow casing coupling with the first hollow casing, an end cover covering the first hollow casing and the second hollow casing, a hollow lower seat disposed between the first hollow casing and the second hollow casing, a blade holder disposed in the art designer blade device, the first hollow casing having a plurality of threaded posts, a taper recess formed on an upper portion of the first hollow casing, a through hole communicating with the taper recess, a round hole communicating with the through hole, an upper chamber formed in the first hollow casing, a lower chamber formed in the first hollow casing, an end chamber formed in an end portion of the first hollow casing, a guide groove formed in a front portion of the first hollow casing, a first distal groove formed in the front portion of the first hollow casing, a compression spring inserted in the upper chamber, and a coiled spring inserted in the lower chamber, the second hollow casing having a circular hole formed on a center portion of the second hollow casing, a taper notch formed in the second hollow casing, a second distal groove formed in a front portion of the second hollow casing, and a plurality of pillars matching the threaded posts, each said pillar inserted in the respective threaded post, the blade holder having a front seat, a plurality of positioning rods disposed in the front seat, an insertion block, an upper plate disposed on the insertion block, and a plurality of cylinder posts disposed on the upper plate, the blade holder inserted in the guide groove, a blade having a plurality of apertures, each said positioning rod inserted in the respective aperture, the insertion block engaging with the hollow lower seat, a button device having a push plate disposed on a top portion of the button device, a lower rod disposed on a bottom of the button device, a lower protrusion disposed on the bottom of the button device, and a positioning post disposed on a distal portion of the button device, the push plate inserted in the taper recess, the lower protrusion inserted in the through hole, a rotating wheel having a center hole receiving the lower rod, a lower taper cone portion, and a helix bar disposed on the lower taper cone portion to engage with the cylinder posts, the rotating wheel inserted in the round hole and the circular hole, the hollow lower seat having a threaded hole and a distal plate, a distal post disposed on the distal plate, the distal plate engaging with the insertion block, the end cover having a pivot hole, the positioning post inserted in the upper chamber, and the compression spring disposed between the positioning post and the button device.

2. An art designer blade device as claimed in claim 1, wherein the art designer blade device further comprises a socket seat, and the socket seat comprises a hollow interior receiving the art designer blade device, two positioning bars disposed in the socket seat to position the art designer blade device, a hollow handle device disposed on a lateral of the socket seat, a rectangular frame disposed on the socket seat, a periphery groove formed on the hollow handle device, a plurality of rectangular holes formed on the hollow handle device, an elastic plate inserted in the rectangular frame, and a lateral cover covering the hollow handle device.

3. An art designer blade device as claimed in claim 2, wherein the lateral cover comprises a plurality of clamp hooks and a semicular groove.

4. An art designer blade device as claimed in claim 2, wherein a rectangular plate is disposed between the elastic plate and the lateral cover.

* * * * *